United States Patent [19]

Rooklyn

[11] Patent Number: 4,855,865

[45] Date of Patent: Aug. 8, 1989

[54] GROUNDING SYSTEM FOR STATIC DISSIPATIVE SURFACES

[75] Inventor: Jack Rooklyn, Northridge, Calif.

[73] Assignee: Industrial Management Co., North Hollywood, Calif.

[21] Appl. No.: 167,960

[22] Filed: Mar. 14, 1988

[51] Int. Cl.[4] ..... H05F 3/02

[52] U.S. Cl. ..... 361/212

[58] Field of Search ..... 361/212, 220; 174/55 B, 174/55 G, 6; 439/92

[56] References Cited

U.S. PATENT DOCUMENTS

| | | | |
|---|---|---|---|
| 4,456,944 | 6/1984 | Rooklyn | 361/212 |
| 4,525,398 | 6/1985 | Rooklyn | 428/40 |
| 4,702,951 | 10/1987 | Rooklyn | 428/193 |
| 4,802,056 | 1/1989 | Aronson | 361/212 |

OTHER PUBLICATIONS

"FORMICA" Brand Anti-Static Laminate Grade-47-/Hap, Formica Corporation publication, 1985.

*Primary Examiner*—L. T. Hix
*Assistant Examiner*—Brian W. Brown
*Attorney, Agent, or Firm*—Evanns & Walsh

[57] ABSTRACT

A grounding system for grounding a static dissipative surface or an object that is static dissipative. A bolt is provided that extends through a hole or bore in the product wherein a static charge is to be grounded. A unique form of head is provided which is conical in shape and is adapted to fit into a conical counterbore to assure that connection is made for electrical conductivity. In one form, a fitting serving as a nut is utilized, which is preferably round and knurled, to provide ease of finger tightening. The outer surface of the conical head is knurled to assure an electrical grounding connection. In a second form of the invention, the head has a bore extending through it with a tapered counterbore which receives the tapered head of a bolt which comes flush with the flat upper surface of the head. Ordinary nuts and washer may be used on the stem of the bolt.

3 Claims, 1 Drawing Sheet

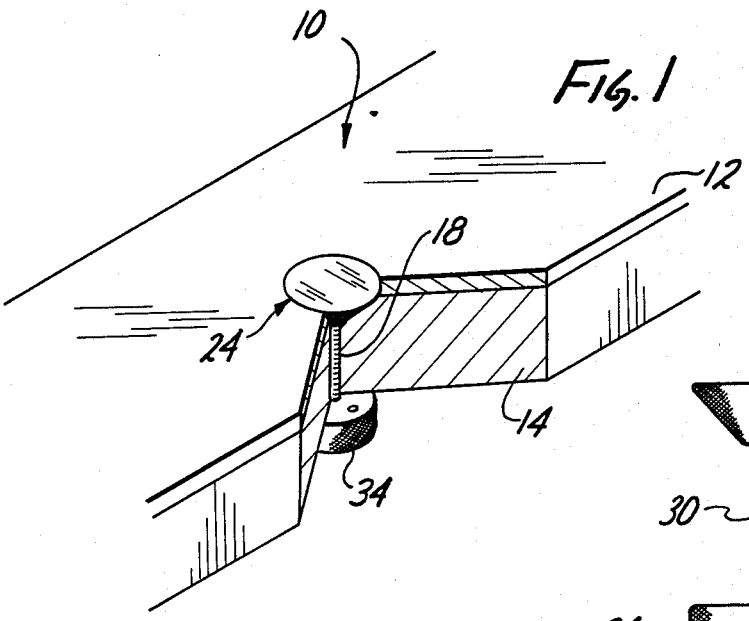
FIG. 1
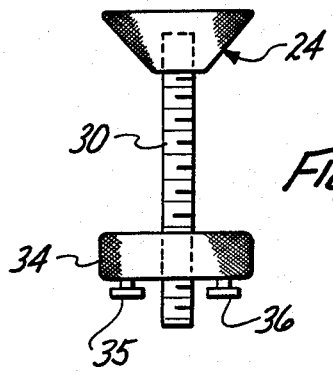
FIG. 2
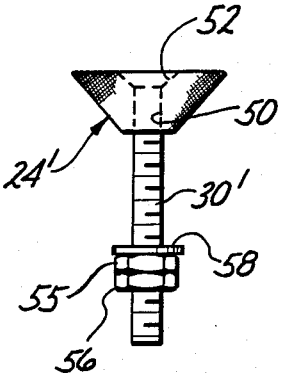
FIG. 3
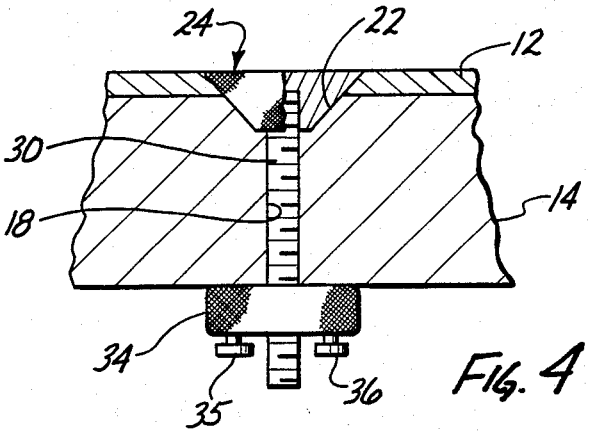
FIG. 4
FIG. 5
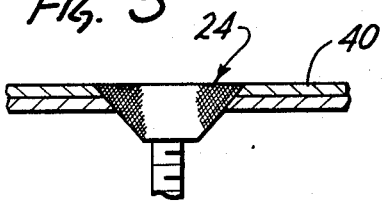
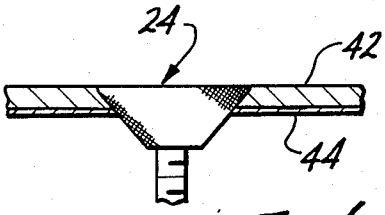
FIG. 6
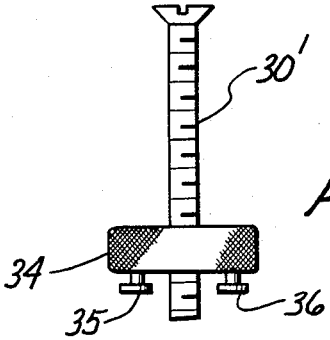
FIG. 7

GROUNDING SYSTEM FOR STATIC DISSIPATIVE SURFACES

BACKGROUND OF THE INVENTION

1. Field of the Invention

The invention is related to static dissipative work surfaces or other static dissipative objects and, more particularly, to a grounding system, that is, parts particularly adapted for making a ground connection from the dissipative surface or object.

2. Description of the Prior Art

The technology relative to static dissipative work surfaces and static dissipative objects is known, particularly as illustrated in the prior patents of the herein inventor. These patents are U.S. Pat. Nos. 4,456,944; 4,525,398; and 4,702,951.

One of the significant problems in the prior art has been the matter of achieving a sufficient and complete grounding connection from a static dissipative work surface to ground. The problem is particularly difficult with respect to some surfaces where the grounding connection may be in the form of a bolt extending through a hole in the material, including the surface of the material. Actual electrical conductivity through the grounding connection may not be assured, and it may be necessary to resort to further instrumentalities to achieve an electrical connection that is adequate. It has been necessary at times to apply electrically conductive paint to the material to assure an electrical grounding connection through the grounding parts.

There are, of course, various different types of work products that are provided with a static dissipative surface or a static dissipative lamination. That is, the product may include a surface part which embodies an electrically conductive lamination. Thus, it happens, depending upon the nature of the product having the static dissipative part, that at times, it is difficult to actually achieve an adequate grounding connection by way, for example, of a grounding bolt extending through the product with the purpose that the grounding bolt will achieve a sufficient actual electrically conductive relationship with the material of the product which is to be static dissipative.

The herein invention, preferred forms of which are described in detail hereinafter, is intended to overcome the deficiencies of the prior art and to provide an extremely practical, effective, and simplified device for providing the ground connection from a static dissipative surface or part.

SUMMARY OF THE INVENTION

Preferred forms of the invention are illustrated in the drawings and described in detail hereinafter.

In one form of the invention, a bolt is provided which is adapted to extend entirely through a hole or bore in the work surface or product that is to be electrically grounded in order to dissipate static charge. In a preferred form, the bolt is provided with a head which is conical in shape having a flat end surface and which is adapted to fit snugly in a conical counterbore in the product to which it is applied. The surface of the conical head is knurled so that when pulled into the conical bore, electrical contact is assured as between the head and the static dissipative product and, particularly, to insure electrical contact between the conical head and any electrically conductive lamination that may form part of the product.

Preferably, a nut is provided which is in the form simply of a cylindrical knob, the outer surface of which is knurled to facilitate hand-gripping of the knob. The knob is threaded onto the bolt stem on the inside or underside of the product having the static dissipative work surface. Preferably, the knob is provided with threaded bores having screws fitted into the bores for the purpose of making other grounding connections to the same elements. The knob is of sufficient size and, with the knurled surface, is readily adapted to be turned finger-tight as necessary.

In another form of the invention, the conical head has a bore extending through it, there being a slanted or conical counterbore at the end of the bore to receive a head formed on the bolt stem which extends through the product to be grounded. Ordinary nuts may be threaded onto the bolt stem along with a washer, or the knurled knob as described can be threaded onto the stem.

In the light of the foregoing, the primary object of the invention is to provide an improved grounding system involving simplified parts for purposes of creating an effective electrically conductive grounding connection from a static dissipative surface or object to ground.

A further object is to realize the purpose of the foregoing object by way of simplified hardware in the form of a bolt provided with a knurled conical head adapted to fit into a conical bore, along with a nut which is simply in the form of a cylindrical part having a knurled outer surface adapting it to be turned finger-tight to clamp the parts to the surface of the part to be grounded.

Another object is to provide a further simplified form of the hardware wherein the knurled conical head has a bore through it with a conical or slanted counterbore adapted to receive the underside of a bolt having a complementary head so that the head can come flush with the top surface of the knurled knob. The bolt itself is simply a standard bolt with a head as described which extends through the bore in the knurled head.

BRIEF DESCRIPTION OF THE DRAWINGS

Fig. 1 is an isometric view, partly cut away, of an installation of a preferred form of the invention in a particle board having a static dissipative surface;

FIG. 2 is a side view of the form of the grounding device or hardware as it appears in FIG. 1;

FIG. 3 is a view of a modified form of the invention wherein a bolt with a tapered flat head is used;

FIG. 4 is a view of the installation of FIG. 1, which is partly in cross-section;

FIG. 5 is a cross-sectional view of an installation similar to that of FIG. 1 but wherein the static dissipative surface is a laminated product;

FIG. 6 is a cross-sectional view of the preferred form of the invention installed in another form of static dissipative surface wherein one lamination is a sheet of metal foil; and FIG. 7 is a side view of the bolt of FIG. 3 with the knurled nut on it.

DESCRIPTION OF A PREFERRED FORM OF THE INVENTION AND BEST MODE OF UTILIZATION

Referring to FIG. 1 of the drawings, this figure shows one form of a static dissipative work surface with a preferred form of the electrical grounding device of the invention. Numeral 10 illustrates a product which is a work surface. This product may be like that of U.S. Pat. No. 4,702,951. Numeral 12 designates an electrically conductive surface on the product. This particular product includes a particle board 14 having the electrically conductive dissipative surface 12 on it.

Numeral 18 designates a bore extending entirely through the product. At the upper end of the bore 18, as may be seen in the cross-sectional view of FIG. 4, there is a conical counterbore 22. The grounding connection parts or hardware include a head, as designated at 24, which has a conical shape adapted to fit into the counterbore 22. The outer end of the head 24 is flat so that it can come down flush with the surface of the lamination 12, as may be seen in the drawings. The outer surface of the head 24 is knurled as illustrated, so that when it is pulled down into the conical counterbore, good electrical contact and connection is made between the head which may be made of brass and the product 14 and particularly the electrically conductive lamination or layer 12.

The parts include both the stem 30 which is, of course, threaded. One end of this threaded stem is threaded into a threaded bore in the head 24, as may be seen. Alternatively, the threaded stem 30 may be simply made integral with the head 24. The stem also may be made of brass. Threaded onto the stem on the underside of the static dissipative product is a member 34 where it serves as a nut. Preferably, this member is circular, that is, round, with the outside surface being knurled, so that it can be readily turned finger-tight on the stem 30 against the yellower side of the product 14. Preferably, the member 34 is provided with two or more threaded bores into which are fitted threaded screw members 35 and 36, to which electrical connections can be readily made from other parts or surfaces which it is desired should be grounded. For example, an operator may be wearing a wristlet which has a grounding connection which can be readily connected to one of the screws 35 or 36. FIG. 5 shows the parts fitting in connection with another form of static dissipative surface which is designated by the numeral 40. This product is one which is laminated, the product including one lamination which is electrically conductive, and the knurled surface of the head 24 comes into electrically conductive relationship with the electrically conductive lamination.

FIG. 6 illustrates another type of static dissipative surface, as identified by the numeral 42, which may be like the surface illustrated in U.S. Pat. No. 4,525,398. In this form of product, an electrically conductive lamination is provided, which may be a metal foil, for example. The knurled surface of the head 24 comes into assured electrically conductive relationship with the lamination 44.

FIG. 3 illustrates a slightly modified form of the invention. In this form of the invention, the head 24' has a bore 50 extending all the way through it, this bore having an end counterbore 52. The bolt 30' is like the stem of the previously described bolt, but it has a head 54 having a tapered underside adapted to fit into the tapered counterbore 52 so that the end of the head comes flush with the flat end of the head 24', ordinary nuts, as designated at 55 and 56, and a washer 58.

From the foregoing, those skilled in the art will readily understand the nature of the invention, its construction, and the manner in which it is utilized in a manner to realize the results as set forth in the foregoing. The device is extremely practical and simplified but very effective for its purpose.

The foregoing disclosure is representative of preferred forms of the invention and is to be interpreted in an illustrative rather than a limiting sense, the invention to be accorded the full scope of the claims appended hereto.

What is claimed is:

1. A grouding attachment device for attachment of a grounding connection to a static dissipative product comprising, in combination, a threaded stem adapted to extend through a hole in the product to be grounded, a grounding connection part at one end of the threaded stem, the said part having a conical shape, the surface of which is knurled and shaped to fit into a conical counterbore in said product, the said part having a flat outer end surface and a flat inner end surface having a diameter slightly larger than the diameter of the threaded stem, a holding member threaded onto the threaded stem, the said holding member being in the form of a cylindrical knob having an outer knurled surface whereby the knob is adapted to be turned to finger-tight condition against said product, the flat lower surface of the said knob having threaded bores in it and threaded members fitting in said bores providing for a plurality of electrical grounding connections to the knob.

2. A grounding attachment device for attachment of a grounding connection to a static dissipative product comprising, in combination, a threaded stem adapted to extend through a hole in the product to be grounded, a grounding connection part at one end of the threaded stem, the said part having a conical shape, the surface of which is knurled and shaped to fit into a conical counterbore in said product, and the knurled surface having a substantial part of its surface area in contact with surfaces of the said product whereby electrical contact is achieved without the use of electrically conductive paint, the said part having a flat outer end surface, and a holding member threaded onto the threaded stem, wherein the threaded stem has a head, the said part has a central bore extending through it and having a counterbore in its outer end surface adapted to receive the head on the end of the said threaded stem.

3. A grounding attachment device for attachment of a grounding connection to a static dissipative product comprising, in combination, a threaded stem adapted to extend through a hole in the product to be grounded, a grounding connection part at one of the threaded stem, the said part having a conical shape, the surface of which is knurled and shaped to fit into a conical counterbore in said product, and the knurled surface having a substantial part of its surface area in contact with surfaces of the said product whereby electrical contact is achieved without the use of electrically conductive paint, the said part having a flat outer end surface, and a holding member threaded onto the threaded stem, wherein the said holding member is in the form of a cylindrical knob having an outer knurled surface whereby the knob is adapted to be turned to finger-tight condition against said product, wherein the said knob has a surface on its bottom side, the said surface having means providing for a plurality of electrical grounding connections.

* * * * *